US007516773B2

(12) United States Patent
Barnes et al.

(10) Patent No.: US 7,516,773 B2
(45) Date of Patent: Apr. 14, 2009

(54) OPTIMIZED TOOLING DESIGN FOR VERTICAL DIE CASTING MACHINES

(75) Inventors: Chuck Barnes, Kalamazoo, MI (US); Zach Brown, Kalamazoo, MI (US); Mark Musser, Osceola, IN (US); Joe Bigelow, Vicksburg, MI (US); Darryl Staats, Clarksville, TN (US)

(73) Assignee: Contech, LLC, Wilmington, DE (US)

( * ) Notice: Subject to any disclaimer, the term of this patent is extended or adjusted under 35 U.S.C. 154(b) by 0 days.

(21) Appl. No.: 11/727,449

(22) Filed: Mar. 27, 2007

(65) Prior Publication Data

US 2007/0261812 A1 Nov. 15, 2007

Related U.S. Application Data

(60) Provisional application No. 60/786,386, filed on Mar. 28, 2006.

(51) Int. Cl.
*B22D 17/12* (2006.01)

(52) U.S. Cl. ..... 164/113; 164/312

(58) Field of Classification Search ..... 164/113, 164/312, 265

See application file for complete search history.

(56) References Cited

U.S. PATENT DOCUMENTS

| | | | | |
|---|---|---|---|---|
| 2,612,666 | A * | 10/1952 | McGarigal | 164/265 |
| 3,208,113 | A * | 9/1965 | Bennett | 164/312 |
| 6,467,528 | B1 | 10/2002 | Kamm et al. | |
| 6,901,991 | B2 * | 6/2005 | Kamm et al. | 164/113 |

FOREIGN PATENT DOCUMENTS

GB 1336305 11/1973

OTHER PUBLICATIONS

Search Report issued by the European Patent Office dated Jan. 2, 2008.

* cited by examiner

*Primary Examiner*—Kevin P Kerns
(74) *Attorney, Agent, or Firm*—Baker & Hostetler LLP

(57) ABSTRACT

An apparatus and method are provided that increase yield and reduce cycle time. In particular, a gate plate for a die casting machine is configured to lessen the waste produced during die casting, resulting in greater yield. Further, the gate plate is configured with tapered sides to produce a draft, leading to less friction during the gate break/pull back sequence. This draft reduces the amount of unpressurized dwell time and subsequently the cycle time for producing the cast part.

20 Claims, 3 Drawing Sheets

OPTIMIZED TOOLING DESIGN FOR VERTICAL DIE CASTING MACHINES

CROSS-REFERENCE TO RELATED APPLICATIONS

This application claims priority to provisional U.S. patent application entitled, "Optimized Tooling Design for Vertical Die Casting Machines," filed Mar. 28, 2006, having a Ser. No. 60/786,386, the disclosure of which is hereby incorporated by reference in its entirety.

FIELD OF THE INVENTION

The present invention relates generally to metal casting. More particularly, the present invention relates to an apparatus and method for increasing the yield during the casting process.

BACKGROUND OF THE INVENTION

Metal casting is an important manufacturing process. Improvements are required to make this process more efficient because metal casting can be an expensive endeavor both in terms of production time as well as in the use of materials. Different types of machines have also been developed to reduce cost and increase efficiency.

The longer it takes to produce a product, the more energy required and therefore more cost to the consumer. Thus, it is desirable to reduce the time necessary to produce the product. Further, lowering the amount of material required to produce a cast part also lowers cost for the consumer. Although there may be some level of waste associated with casting, minimizing that waste reduces cost in several ways. Less material wasted means more material is available for use for casting the product. Also, less material wasted results in lower costs associated with recycling the waste.

Therefore, it is desirable to reduce waste and improve yield. It is also desirable to reduce cycle time and therefore the costs associated with metal casting. Accordingly, a simple cost effective apparatus is needed that simultaneously increases yield and reduces cycle time.

SUMMARY OF THE INVENTION

The foregoing needs are met, to a great extent by the present invention, wherein in one aspect an apparatus is provided that in some embodiments allows for die casting with reduced waste and cycle time.

In accordance with one aspect of the present invention, a gate plate for use in a die casting machine is provided and can include at least one opening that is defined by the gate plate, the opening defining a flow path for a molten metal. The gate plate can also include and a top surface including the opening, a bottom portion including a first bottom surface having a first width, a middle portion having a second width that is different from the first width, wherein a taper is formed by the first width and the second width, and a center portion having a second bottom surface on a substantially different plane than the first bottom surface and configured such that a biscuit is received within the center portion. The second width can be greater than the first width.

In accordance with another aspect of the present invention, a side of the biscuit can be formed by the taper of the gate plate. The gate plate's first bottom surface and second bottom surface can form a top of the biscuit. The center portion of the gate plate can protrude into the biscuit, and the center portion of the gate plate can reduce the amount of molten metal in a center of the biscuit as compared to other areas of the biscuit. Also, the taper can be designed to assist the biscuit's removal from the gate plate, and the opening can receive a gate that injects the molten metal into a die.

In accordance with still another aspect of the present invention, a die casting machine is provided including a shot sleeve, a shot piston received by the shot sleeve, and a die set having an upper die member and a lower die member that define a cavity configured to produce a cast. The die casting machine can include a gate plate including at least one opening that is defined by the gate plate, the opening defining a flow path for a molten metal into the cavity. The opening can receive a gate that injects the molten metal into a die. The gate plate of the die casting machine can also include and a top surface including the opening, a bottom portion including a first bottom surface having a first width, a middle portion having a second width that is different from the first width, wherein a taper is formed by the first width and the second width, and a center portion having a second bottom surface on a substantially different plane than the first bottom surface and configured such that a biscuit is received within the center portion. The second width can be greater than the first width.

In accordance with yet another aspect of the present invention a side of the biscuit can be formed by the taper of the gate plate, and the gate plate's first bottom surface and second bottom surface can form a top of the biscuit. The center portion of the gate plate can protrude into the biscuit, and the center portion of the gate plate can also reduce the amount of molten metal in a center of the biscuit as compared to other areas of the biscuit. The taper can also be designed to assist the biscuit's removal from the gate plate.

In accordance with even another aspect of the present invention, a method of die casting is provided including injecting a molten metal into a die cavity of a die casting machine using a shot piston disposed within a shot sleeve and a gate plate that receives gates through which the molten metal from the shot piston enters the die cavity. The method also includes forming a biscuit within at least a portion of the gate plate from a portion of the molten metal and includes reducing friction between the biscuit and the shot sleeve during a pull back and gate break sequence with a taper on the side of the biscuit that was formed during the forming step of the biscuit.

In accordance with yet another aspect of the present invention, the method can further include reducing a volume of a center of the biscuit as compared to other areas of the biscuit with a center portion of the gate plate protruding into the center of the biscuit. Also, the method wherein forming the taper is done with the gate plate having a bottom portion with a first width and a middle portion having a second width that is different from the first width can be included. The second width can be greater than the first width. Finally, the method can further include forming a side of the biscuit with the gate plate.

In accordance with yet another aspect of the present invention, a gate plate for use in a die casting machine is provided including at least one opening that is defined by the gate plate, the opening defining a flow path for a molten metal. The gate plate can include a top surface including the opening, a bottom portion including a first bottom surface having a first width, a middle portion having a second width that is different from the first width, wherein a taper is formed by the first width and the second width, and a center portion configured such that a portion of a biscuit is received within the center portion.

There has thus been outlined rather broadly, certain embodiments of the invention in order that the detailed description thereof herein may be better understood, and in order that the present contributions to the art may be better appreciated. There are of course additional embodiments of the invention that will be described below and which will form the subject matter of the claims appended hereto.

In this respect before explaining at least one embodiment of the invention in detail it is to be understood that the invention is not limited in its application to the details of construction or arrangements of the components set forth in the following description or illustrated in the drawings. The invention is capable of embodiments in addition to those described and of being practiced and carried out in various ways. Also, it is to be understood that the phraseology and terminology employed herein, as well as in the abstract, are for the purpose of description and should not be regarded as limiting.

As such, those skilled in the art will appreciate that the conception upon which this disclosure is based may be utilized readily as a basis for the designing of other structures, methods, and systems for carrying out the several purposes of the present invention. It is important therefore that the claims be regarded as including such equivalent constructions insofar as they do not depart from the spirit and scope of the present invention.

DETAILED DESCRIPTION

Figure 1:
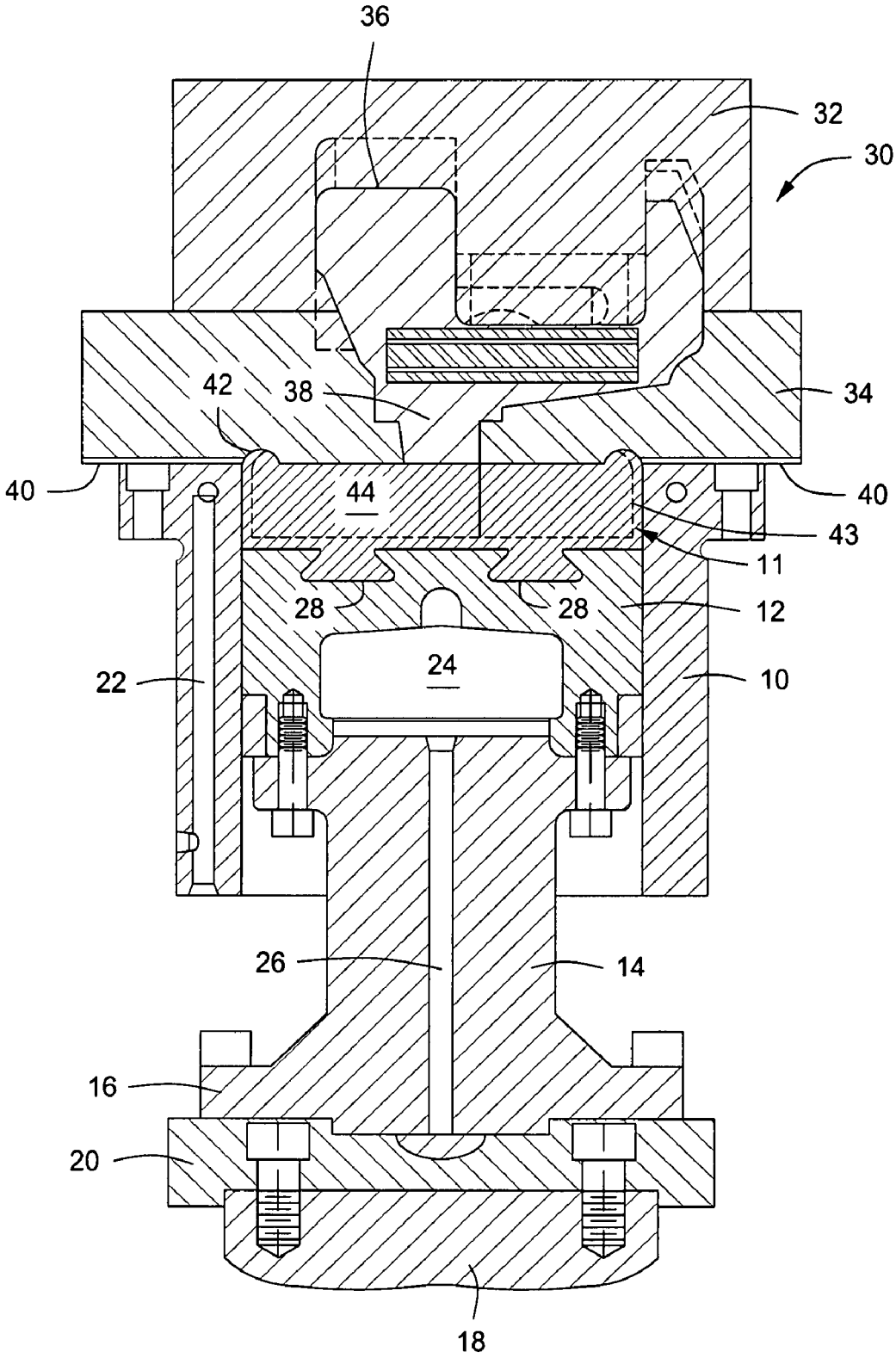
FIG. 1 is a side plan view of a vertical die casting press.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the disclosure be regarded as including such equivalent constructions insofar as they do not depart from the spirit and scope of the present invention.

The invention will now be described with reference to the drawing figures, in which like reference numerals refer to like parts throughout. An embodiment in accordance with the present invention provides a gate plate configured to simultaneously increase yield and reduce cycle time.

FIG. 1 is a side plan view of a vertical die casting press 1. Such a press is disclosed in U.S. Pat. No. 6,467,528 by Kamm, et al. A cylindrical shot sleeve 10 receives a vertical shot piston 12 mounted on a shot piston rod 14 having a flange 16. The piston rod 14 is releasably coupled to a piston rod 18 of a hydraulic shot cylinder (not shown) by a coupling plate 20. The shot sleeve 10 has circumferentially spaced water cooling passages 22 for maintaining the shot sleeve 10 within a predetermined temperature range. The shot piston 12 has a water cooling chamber 24 which receives cooling water through passages 26 within the shot piston rod 14. A pair of dovetail slots 28 are formed on the shot piston 12 to receive a bottom portion of a biscuit 44.

Further, a die set 30 is disposed above the shot sleeve 10 and shot piston 12 and includes an upper die member 32. The die set 30 also includes a lower die member 34. The upper die member 32 and the lower die member 34 define a die cavity 36 that is configured to produce a cast product.

The lower die member 34 defines a plurality of apertures 38 which connect the cavity 36 to the shot sleeve 10. The apertures 38 taper outwardly towards the cavity 36. The apertures 38 may comprise any number of apertures 38 as desired. The inlet of one of the apertures 38 is located in the center portion of the shot sleeve 10 and has a diameter substantially smaller than the diameter of the shot sleeve 10. The lower die member 34 also defines an annular metal entrapment cavity or recess 42 which extends upwardly into the lower die member 34 from an inner cylindrical surface of the shot sleeve 10.

A series of vent passages or slots 40 are formed within a bottom surface of the lower die member 34 and extend from the metal entrapment recess 42. When the molten metal is moving upwardly with the shot piston 12 within the shot sleeve 10, the air displaced within the shot sleeve 10 flows through the vent slots 40.

In operation, the upper die member 32 is shifted downwardly to a position on top of the lower die member 34. The upper die member 32 is clamped to the lower die member 34 by the hydraulic clamping cylinder (not shown). Molten metal is then poured into a shot cavity 11 defined by the shot sleeve 10 and shot piston 12. The shot sleeve 10 and molten metal are then indexed or shifted laterally to a position under the die set 30. The shot piston 12 is then moved upwardly by the piston rod 18 of the hydraulic shot cylinder. The molten metal within the shot sleeve 10 is forced upwardly through the apertures 38 and into the die cavity 36 until the molten metal completely fills the die cavity 36.

Due to the water cooled shot sleeve 10 and the water cooled shot piston 12, pre-solidified metal forms adjacent the shot sleeve 10 and the shot piston 12 as generally indicated by the dotted line 43. This leads to the formation of a biscuit 44, which includes the metal or waste remaining after the product has been formed. The biscuit 44 includes pre-solidified metal which collapses along the inner cylindrical surface of the shot sleeve 10, and the annular entrapment recess 42 so that the pre-solidified metal does not flow radially inwardly into the apertures 38 and into the cavity 36. This ensures that only the highest quality molten metal within the center portion of the shot sleeve 10 fills the die cavity 36. The small area of the apertures 38 also prevents pre-solidified metal from entering the apertures 38.

After the molten metal has substantially solidified within the die cavity 36 and the metal forming the biscuit 44 has partially solidified, the shot piston 12 is moved downwardly so that the biscuit 44 breaks or severs from the partially solidified metal within the apertures 38 at the bottom of the lower die member 34. The biscuit 44 is then ejected and recycled.

Although, this particular machine has a lower die member 34 with apertures 38, other machines have a separate lower die member and a gate plate with gate openings. In such an instance, the gate plate sits atop the shot sleeve 10 and the lower die member sits atop the gate plate. The upper die member comes down onto the lower die member. The gate plate, having gate openings that function in a similar manner as the apertures 38, permits molten metal to enter into the die cavity formed by the contacting upper and lower die members. Thus, a single lower die member or a combination of a lower die member along with a gate plate, work similarly.

Figure 2:
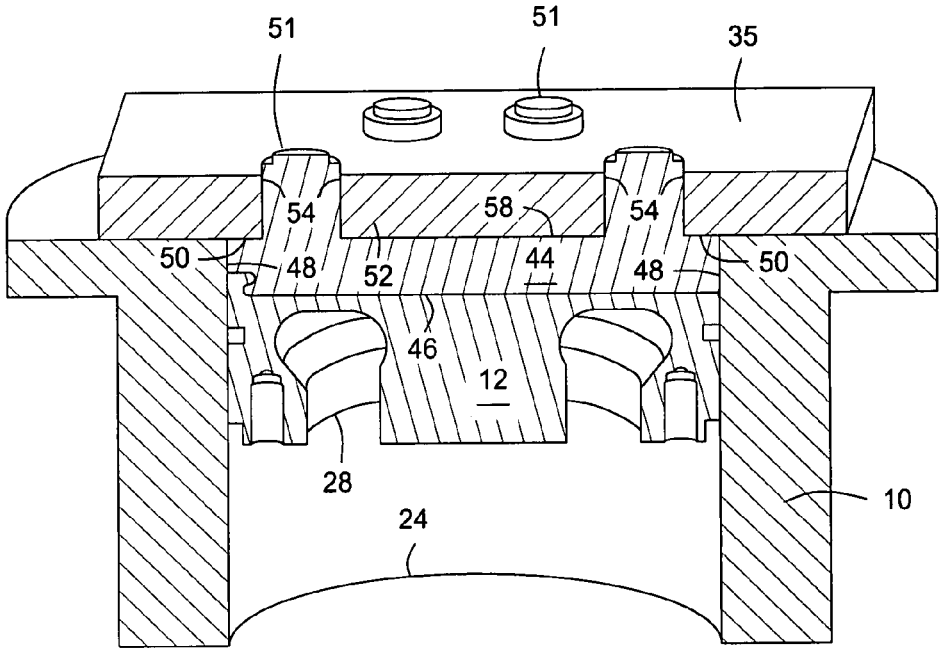
FIG. 2 (PRIOR ART)
FIG. 2 is a perspective view of a gate plate according to the prior art.

FIG. 2 is a perspective view of a gate plate 35 according to the prior art. The outside diameter of a biscuit 44 is defined by the diameter of the shot sleeve 10. Thus, the biscuit's outer diameter is equivalent to the inner diameter of the shot sleeve 10 because the biscuit 44 is formed within the shot sleeve 10. As is evident from this view, the biscuit 44 is formed between the gate plate 35 and the top surface of the shot piston 12. The shape of the biscuit 44 formed in the prior art is defined by the shot sleeve 10, the top surface of the shot piston 12 and the gate plate 35.

Here, a bottom 46 of the biscuit 44 lays atop the shot piston 12. The sides 48 of the biscuit 44 are formed wholly by the shot sleeve 10. The top 50 of the biscuit 44 is defined by the gate plate 35. It is this contact between the biscuit 44 and the shot sleeve 10 that has the potential to damage the shot sleeve 10. Therefore, shrinkage of the biscuit's sides 48 from contact with the shot sleeve 10 is necessary before the biscuit 44 can be pulled back. This shrinkage is down time during manufacturing and is further discussed below.

Once the cast product has been formed, the shot piston 12 retracts down in the shot sleeve 10 and the biscuit 44 is pulled along with the shot sleeve 10. The pulling back of the biscuit 44 from the gate plate 35 is referred to as "pull back/gate break" sequence. As the biscuit 44 is pulled back, it "breaks" or loses its contact with the product in the die cavity 36 at the gate openings 51. The smaller gate openings 51 allow for ease of breaking the biscuit 44 away from the product. Meanwhile, the biscuit 44 has generally solidified.

To pull the biscuit 44 back, the biscuit 44 has to shrink away from the shot sleeve 10. This is to reduce the amount of friction between the biscuit 44 and the shot sleeve 10. The time required for the biscuit 44 to shrink away from the shot sleeve 10 is referred to as unpressurized dwell time. Contributing to the unpressurized dwell time are the metal temperature and the dimensions of the biscuit 44 along with the physical condition of the shot sleeve 10.

Unpressurized dwell time may range from 5 to 80 seconds. Unpressurized dwell time can sometimes account for nearly 25% of the total machine cycle time. Thus, reducing or eliminating the unpressurized dwell time necessarily reduces cycle time and renders machine productivity more efficient.

If the biscuit 44 is pulled back without giving the biscuit 44 time to shrink, the amount of friction would be significant and the act of pulling back the biscuit 44 may damage the shot sleeve 10. The metal of the biscuit 44 may enter cracks in the shot sleeve 10 and worsen the cracks, tearing apart the shot sleeve 10. A damaged shot sleeve 10 would result in a long period of machine downtime, adversely affecting the production cycle and greatly increasing the cost.

Also, it can be seen that the bottom 46 of the biscuit 44 is formed by the top surface of the shot piston 12. The sides 48 of the biscuit 44 are defined by the shot sleeve 10 and the top 50 of the biscuit 44 is defined by the gate plate 35. Much of the biscuit 44 top 50 is flush with the top of the shot sleeve 10.

Figure 3:
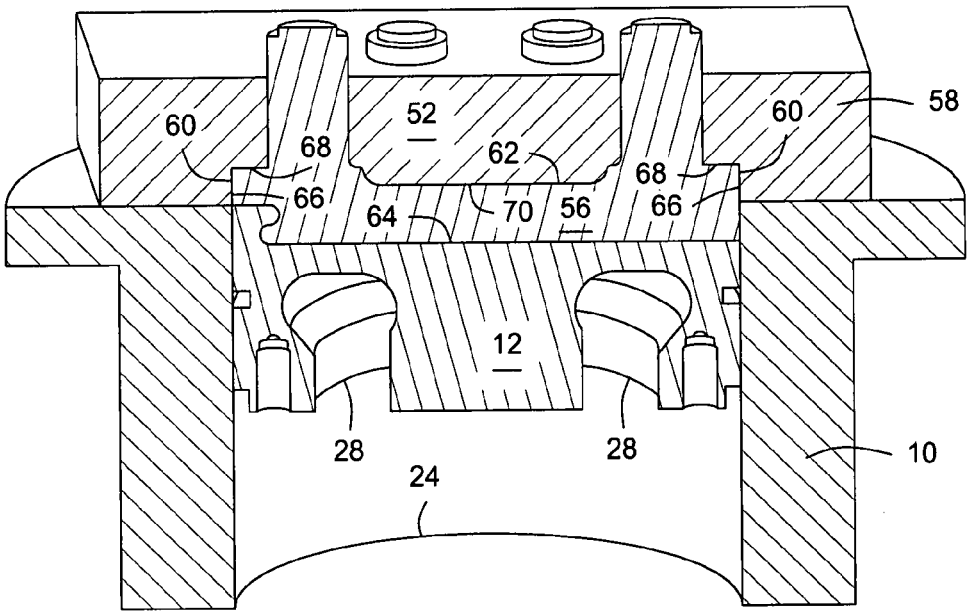
FIG. 3 is a perspective view of a gate plate according to an embodiment of the present invention.

FIG. 3 is a perspective view of a gate plate 58 according to an embodiment of the present invention. The gate plate 58 can be used with the various cast machines, including the cast machines described herein. Here the biscuit 56 is formed within the gate plate 58 and not within the shot sleeve 10. The bottom 64 of the biscuit 56 is defined by the top surface of the shot piston 12. However, the sides 66 of the biscuit 56 and the top 68 of the biscuit 56 are formed by the gate plate 58. Also, the sides 66 are angled away from the shot sleeve 10, creating a draft on the sides 66 of the biscuit 56.

Such a draft reduces the amount of friction between the biscuit 56 and the shot sleeve 10 during the pull back/gate break sequence. Friction is reduced because the draft ensures that there is less contact between the biscuit 56 and the shot sleeve 10. This reduction of the friction reduces or eliminates the unpressurized dwell time, improving the overall efficiency of the machine cycle.

FIG. 3 also shows the configuration of the gate plate 58 is such that it reduces the amount and the volume of the biscuit 56. The center 70 of the biscuit 56 in an embodiment of the present invention is thinner than the center 52 of the biscuit 44 resulting from the prior art. Correspondingly, the center 62 of the gate plate 58 in an embodiment of the present invention is thicker than the center of the gate plate 35 according to the prior art. Additionally, the top surface of the center 70 is lower than the top surface 68 of the biscuit 56. In this way, the amount of the biscuit 56 formed, i.e. the waste produced per cast product is reduced. The reduced waste allows for the shot piston 12 to be stationed at a height higher than possible in the prior art. Therefore, the lower the waste, the more metal used for the product, thus the greater the yield.

Yield is a term used to describe the efficiency of a casting process. It is the ratio of the amount of product versus the amount of waste produced in making the product. Thus, a product weighing 20 pounds, with a biscuit weighing 20 pounds results in a yield of 50%. The 50% figure results from 20 pounds of product being divided by 40 pounds (the sum of the 20 pounds of product and 20 pounds of waste). Thus, even a 10 pound reduction in the amount of the biscuit can have significant results. 20 pounds of product divided by 30 pounds (20 pounds of product plus 10 pounds of biscuit) results in a yield of 66%, an increase in yield of 16%. Thus, less biscuit means greater yield and greater efficiency, resulting in a cost savings.

Figure 4:
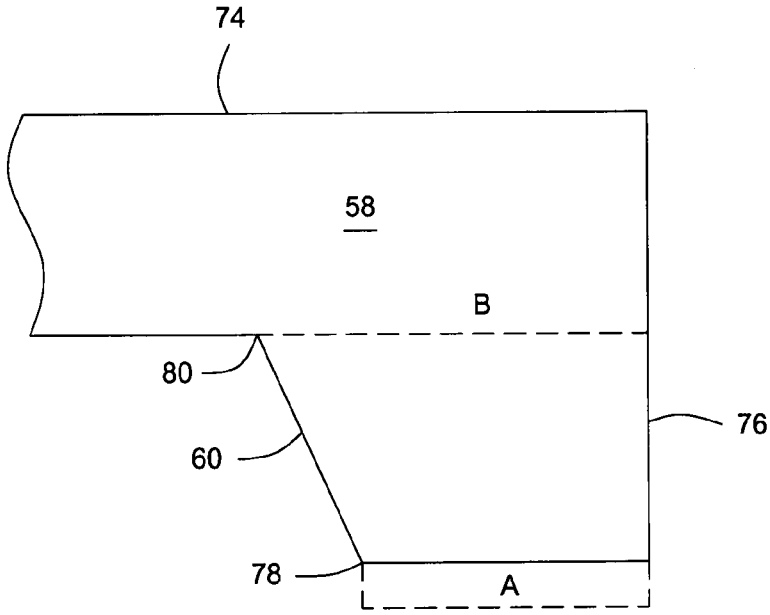
FIG. 4 is a detail view of a taper of the gate plate according to an embodiment of the present invention.

FIG. 4 is a detail view of a taper 60 or draft of the gate plate 58 according to an embodiment of the present invention. The taper 60 of the gate plate 58 according to an embodiment of the invention is angled in a direction toward the center of the gate plate 58. The gate plate 58 has a top 74, side 76, taper bottom 78, taper 60 and a taper top 80.

Length A is defined by the distance between the side 76 and the taper bottom 78. Length B is defined by the distance between the side 76 and the taper top 80. Although, a variety of configurations may be used to effect the taper 60 on the biscuit, as long as length B is greater than length A or taper 60 is at an angle relative to side 76, the appropriate taper or draft will be formed on the biscuit 56, allowing for little or no unpressurized dwell time.

Also, the center 62 of the gate plate 58 (FIG. 3) is larger, having a greater volume than the gate plate 35 of the prior art. The larger volume of the gate plate 58 according to an embodiment of the present invention ensures that the biscuit 56 is smaller, thus wasting less material. In an embodiment of the invention, the gate plate 58 would have a configuration that allows it to reduce the biscuit volume by between about 10% and 60%. In another embodiment of the invention, the gate plate 58 would have a configuration that allows it to reduce the biscuit volume by between about 10% and 40%. Any type of configuration may be used. Any dimensions resulting in such reduced volume may be used.

Additionally, lower waste reduces cost in that less biscuit material needs to be recycled back into usable metal. Thus, less material is used to produce the cast product and less material has to be recycled. Overall efficiency and cost are greatly improved.

Gate plate designs may vary significantly, yet still provide for greater yield and reduced cycle time. Thus, an embodiment of the present invention provides for a gate plate configuration that results in a smaller biscuit that has a tapered outer diameter. The number of gate openings and their configuration may also vary.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A gate plate for use in a die casting machine, comprising:

at least two openings that are defined by the gate plate, the openings defining a flow path for a molten metal;

a top surface including the openings;

a bottom portion including a first bottom surface having a first width defined by a distance between an outside edge and an inside edge of the first bottom surface;

a middle portion having a second width defined by a distance between an outside edge and an inside edge of the middle portion, wherein the second width is different from the first width, and a taper is formed by the first width and the second width; and a center portion disposed between the at least two openings having a second bottom surface on a substantially different plane than the first bottom surface and configured such that a biscuit is received within the center portion and wherein the center portion of the gate plate protrudes into the biscuit.

2. The gate plate of claim 1, wherein a side of the biscuit is formed by the taper of the gate plate.

3. The gate plate of claim 1, wherein the gate plate's first bottom surface and second bottom surface form a top of the biscuit.

4. The gate plate of claim 1, wherein the center portion of the gate plate reduces the amount of molten metal in a center of the biscuit as compared to other areas of the biscuit.

5. The gate plate of claim 1, wherein the second width is greater than the first width.

6. The gate plate of claim 1, wherein the taper is designed to assist the biscuit's removal from the gate plate.

7. The gate plate of claim 1, wherein the opening receives a gate that injects the molten metal into a die.

8. A die casting machine, comprising:

a shot sleeve;

a shot piston received by the shot sleeve;

a die set having an upper die member and a lower die member that define a cavity configured to produce a cast; and a gate plate, comprising:

at least two openings that are defined by the gate plate, the openings defining a flow path for a molten metal into the cavity;

a top surface including the openings;

a bottom portion including a first bottom surface having a first width defined by a distance between an outside edge and an inside edge of the first bottom surface;

a middle portion having a second width defined by a distance between an outside edge and an inside edge of the middle portion, wherein the second width is different from the first width and a taper is formed by the first width and the second width; and a center portion disposed between the openings having a second bottom surface on a substantially different plane than the first bottom surface and configured such that a biscuit is received within the center portion.

9. The die casting machine of claim 8, wherein a side of the biscuit is formed by the taper of the gate plate.

10. The die casting machine of claim 8, wherein the gate plate's first bottom surface and second bottom surface form a top of the biscuit.

11. The die casting machine of claim 8, wherein the center portion of the gate plate protrudes into the biscuit.

12. The die casting machine of claim 8, wherein the center portion of the gate plate reduces the amount of molten metal in a center of the biscuit as compared to other areas of the biscuit.

13. The die casting machine of claim 8, wherein the second width is greater than the first width.

14. The die casting machine of claim 8, wherein the taper is designed to assist the biscuit's removal from the gate plate.

15. The die casting machine of claim 8, wherein the opening receives a gate that injects the molten metal into a die.

16. A method of die casting, comprising:

injecting a molten metal into a die cavity of a die casting machine using a shot piston disposed within a shot sleeve and a gate plate that receives gates through which the molten metal from the shot piston enters the die cavity;

forming a biscuit within at least a portion of the gate plate from a portion of the molten metal;

reducing friction between the biscuit and the shot sleeve during a pull back and gate break sequence with a taper on the side of the biscuit that was formed during the forming step of the biscuit; and reducing a volume of a center of the biscuit as compared to other areas of the biscuit with a center portion of the gate plate protruding into the center of the biscuit.

17. The method of claim 16, wherein forming the taper is done with the gate plate having a bottom portion with a first width defined by a distance between an outside edge and an inside edge of the bottom portion and a middle portion having a second width defined by a distance between an outside edge and an inside edge of the middle portion, wherein the second width is different from the first width.

18. The method of claim 16 further comprising forming a side of the biscuit with the gate plate.

19. The method of claim 17, wherein the second width is greater than the first width.

20. A gate plate for use in a die casting machine, comprising:

at least two openings that are defined by the gate plate, the openings defining a flow path for a molten metal;

a top surface including the openings;

a bottom portion including a first bottom surface having a first width defined by a distance between an outside edge and an inside edge of the first bottom surface;

a middle portion having a second width defined by a distance between an outside edge and an inside edge of the middle portion, wherein the second width is different from the first width and a taper is formed by the first width and the second width; and a center portion disposed between the openings having a second bottom surface on a substantially different plane than the first bottom surface and configured such that a biscuit is received within the center portion.

* * * * *